US005322966A

United States Patent [19]

Shimaya

[11] Patent Number: 5,322,966

[45] Date of Patent: Jun. 21, 1994

[54] ELECTRONIC MUSICAL INSTRUMENT

[75] Inventor: Hideaki Shimaya, Hamamatsu, Japan

[73] Assignee: Yamaha Corporation, Hamamatsu, Japan

[21] Appl. No.: 812,576

[22] Filed: Dec. 20, 1991

[30] Foreign Application Priority Data

Dec. 28, 1990 [JP] Japan ..... 2-416356

[51] Int. Cl.[5] ..... G10H 1/38; G10H 1/42; G10H 1/46

[52] U.S. Cl. ..... 84/637; 84/613; 84/633

[58] Field of Search ..... 84/610, 613, 634, 637, 84/633

[56] References Cited

U.S. PATENT DOCUMENTS

| | | | |
|---|---|---|---|
| 4,429,606 | 2/1984 | Aoki | 84/DIG. 22 X |
| 4,450,742 | 5/1984 | Sugiura | 84/DIG. 22 X |
| 4,470,332 | 9/1984 | Aoki | 84/DIG. 22 X |
| 4,499,808 | 2/1985 | Aoki | 84/DIG. 22 X |
| 5,056,401 | 10/1991 | Yamaguchi et al. | 84/637 |
| 5,179,240 | 1/1993 | Mizuno et al. | 84/613 |

*Primary Examiner*—William M. Shoop, Jr.
*Assistant Examiner*—Jeffrey W. Donels
*Attorney, Agent, or Firm*—Graham & James

[57] ABSTRACT

An electronic musical instrument is disclosed which is capable of performing an automatic accompaniment in response to the operation of the instrument by a performer. The disclosed electronic musical instrument comprises an operational unit consisting of multiple keys; chord determination means for determining a chord in an accompaniment based on the state of the operational unit; accompaniment pattern generation means for generating an accompaniment pattern consisting of note data representing a sequence of notes, such that the accompaniment pattern is generated by sequentially reading note data representing at least one note from a memory device in accordance with the progression of a song; a supplementary note data table for generating supplementary note data designating at least one supplementary note for the chord based on the chord type and note data, such that any supplementary note designated by the supplementary note data is a note other than notes designated by note data from the accompaniment pattern generation means; and a tone generator for generating chords consisting of tones designated by the note data from the accompaniment pattern generation means and supplementary note data. With the disclosed device, an automatic accompaniment can be generated which has a pleasing and natural harmony, and which is accomplished with efficient and economical utilization of available data storage resources.

10 Claims, 10 Drawing Sheets

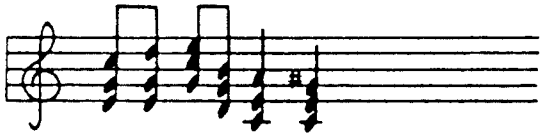
FIG.8
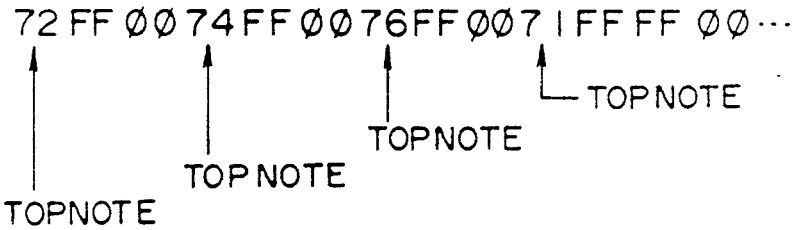
FIG.9
| MOD | 0 | 1 | 2 | 3 | 4 | 5 | 6 | 7 | 8 | 9 | 10 | 11 |
|---|---|---|---|---|---|---|---|---|---|---|---|---|
| NOTE | C | C# | D | D# | E | F | F# | G | G# | A | A# | B |
FIG.10

| | | NOTE TRANSPOSITON | | | | | | | | | | | |
|---|---|---|---|---|---|---|---|---|---|---|---|---|---|
| FROM | TO | C | C# | D | D | B | F | F# | G | G# | A | A# | B |
| M | m | | | | | -1 | | | | | -2 | | 1 |
| | 7 | | | | | | | | | | 1 | | 1 |

FIG.11

| | TOP NOTE RELATIVE TO ROOT NOTE | 0 | 1 | 2 | 3 | 4 | 5 | 6 | 7 | 8 | 9 | 10 | 11 | time | vel. |
|---|---|---|---|---|---|---|---|---|---|---|---|---|---|---|---|
| CHORD TYPE | M | -5 | -6 | -7 | -6 | -4 | -5 | -6 | -3 | -4 | -5 | -4 | -4 | 00 | ED |
| | | -8 | -9 | -10 | -9 | -9 | -8 | -9 | -7 | -8 | -9 | -9 | -9 | 00 | EC |
| | m | -5 | -6 | -7 | -3 | -4 | -5 | -3 | -4 | -5 | -6 | -5 | -4 | 00 | ED |
| | | -8 | -9 | -10 | -8 | -9 | -10 | -9 | -7 | -8 | -9 | -8 | -9 | 00 | EC |
| | 7 | -2 | -3 | -4 | -5 | -6 | -7 | -6 | -7 | -4 | -5 | -6 | -3 | 00 | ED |
| | | -8 | -9 | -9 | -10 | -9 | -10 | -9 | -9 | -10 | -11 | -11 | -9 | 00 | EC |

FIG.12

ELECTRONIC MUSICAL INSTRUMENT

FIELD OF THE INVENTION

The present invention relates to electronic musical instruments, and more particularly, to electronic musical instruments which perform automatic accompaniments.

PRIOR ART

Electronic musical instruments capable of performing accompaniments automatically are conventionally known. In the case of electronic keyboard instruments of this type, a contiguous portion of the keyboard can be allocated for automatic accompaniment use. When an individual playing the keyboard instrument depresses one of the keys within the previously allocated automatic accompaniment use region, in response to the particular key which has been depressed, a corresponding predetermined chord is determined. In response to this chord, a predetermined automatic accompaniment pattern is generated.

For the purpose of automatic accompaniment with this type of electronic musical instrument, typically, the automatic accompaniment pattern is made up of predetermined standard chords, for example, C major, C 7th, etc. Based on the determined chord type (major, minor, augmented, 6th for example) and root note for a chord actually played, each note in a predetermined automatic accompaniment pattern is modified, the details of which are explained below.

Based on the determined root note, each note in the automatic accompaniment pattern is accordingly transposed, while at the same time, notes within chords of the transposed pattern are modified to best suit the determined chord type. Thus, note intervals in the transposed standard chords are adjusted based on chord type in consideration of the relationship between notes in the chords of the standard automatic accompaniment pattern and those of the chord actually played, such that notes are considered as chord notes which are notes forming standard chords, as scale notes which are not part of the standard chords, but are part of the musical scale being played, and as non-scale notes which neither form the standard chords or lie on the musical scale.

As an example of chord note conversion, notes which are chord notes for the standard chords and are scale notes for the actually played chord are converted to the closest corresponding chord notes. Notes which are chord notes both for the standard and actually played chords are not converted.

As it so happens, conventional electronic musical instruments which provide automatic accompaniment capabilities utilizing the above described conversion mechanism are fraught with several shortcomings. One of these relates to the fact that data must be stored for each chord which can be played as part of an automatic accompaniment, for which reason the data storage capacity requirements for such an electronic musical instrument become significantly great.

Another drawback inherent to conventional electronic musical instruments of the type described above is that automatic accompaniment chord progressions tend to be quite rigidly defined, such that when the above type of conversion mechanism is employed, the resulting automatic accompaniment sounds overly simplistic or even unnatural. Considering the example of a conventional piano, however, the chords making up the accompaniment part played by a skilled individual are essentially infinitely diverse, with widely varying degrees of temperament and complexity. Thus, with an electronic musical instrument having conventional automatic accompaniment capabilities, it becomes practically impossible to emulate the nuances and rich diversity that a skilled musician can impart to the accompaniment part of a musical composition played on a conventional musical instrument.

SUMMARY OF THE INVENTION

In consideration of the shortcomings inherent to conventional electronic musical instruments with automatic accompaniment capabilities, it is an object of the present invention to provide an electronic musical instrument capable of automatically performing accompaniment parts with a pleasing and natural sounding harmony, and which in doing so, efficiently and economically utilizes available data storage resources.

So as to achieve the above object, in one aspect of the present invention, an electronic musical instrument is provided comprising an operational unit consisting of multiple keys; chord determination means for determining a chord type for a chord in an accompaniment based on the state of the above mentioned operational unit; accompaniment pattern generation means for generating an accompaniment pattern consisting of note data representing a sequence of notes, such that the accompaniment pattern is generated by sequentially reading note data representing at least one note from a memory device in accordance with the progression of a song; a supplementary note data table for generating supplementary note data designating at least one supplementary note for the above mentioned chord based on the chord type and note data, such that any supplementary note designated by the supplementary note data is a note other than notes designated by the note data from the accompaniment pattern generation means; and a tone generator for generating chords consisting of tones designated by the note data from the accompaniment pattern generation means and supplementary note data, thereby generating the above mentioned chord for an accompaniment.

With the above described electronic musical instrument in accordance with the present invention, in the case of automatic accompaniment, when a performer depresses keys of the operational unit in the automatic accompaniment region, based on the resulting state of the operational unit, a chord type is determined by the chord determination means. Note data for at least one note of the chord is then generated by the accompaniment pattern generation means. Then, supplementary note data for notes other than any notes designated by the note data from the accompaniment pattern generation means are read out from the supplementary note data table based on the note data and on the determined chord type. The chord for the accompaniment is then generated based on the note data and supplementary note data, in response to the performer's depression of keys of the operational unit.

Also so as to achieve the above described object, in another aspect of the present invention, an electronic musical instrument is provided, wherein in addition to supplementary note data, the supplementary note data table determines tone generation delay interval data and volume data for the supplementary note data determined thereby. When producing a chord for an accompaniment, in addition to note data from the accompaniment pattern generation means and supplementary note data from the supplementary note data table, the tone generator provided in this aspect of the present invention utilizes the tone generation delay interval data and volume data supplied from the supplementary note data table when generating the tones designated by the supplementary note data.

With the above described second aspect of the electronic musical instrument in accordance with the present invention, during automatic accompaniment, when a performer depresses keys of the operational unit in the automatic accompaniment region, based on the resulting state of the operational unit, a chord type is determined by the chord determination means. Note data for at least one note of the chord is then generated by the accompaniment pattern generation means. Then, supplementary note data for notes other than any notes designated by note data from the accompaniment pattern generation means are read out from the supplementary note data table based on the note data and on the determined chord type, and in addition to the supplementary note data, tone generation delay interval data and volume data for the supplementary note data are read out from the supplementary note data table. The chord for the accompaniment is then generated based on the note data and supplementary note data, in response to the performer's depression of keys of the operational unit, such that generation of notes designated by supplementary note data are generated based additionally on the corresponding tone generation delay interval data and volume data.

BRIEF DESCRIPTION OF THE DRAWINGS

FIG. 8 is a portion of a musical score to which reference is made in a description of the performance pattern of electronic musical instrument shown in FIG. 2 above.

FIG. 9 is an explanatory figure illustrating MIDI note numbers corresponding to the portion of the musical score shown in FIG. 8.

FIG. 10 illustrates the relationship between note numbers and note names determined through processing of note numbers.

FIG. 11 illustrates a note data conversion data table used for note data conversion of top notes of chords based on the chord type.

FIG. 12 illustrates a harmony table used for determining supplemental notes from the uppermost and lowermost notes of a chord.

DETAILED DESCRIPTION OF THE PREFERRED EMBODIMENTS

In the following, the preferred embodiments of the present invention will be described with reference to the appended drawings.

Figure 1:
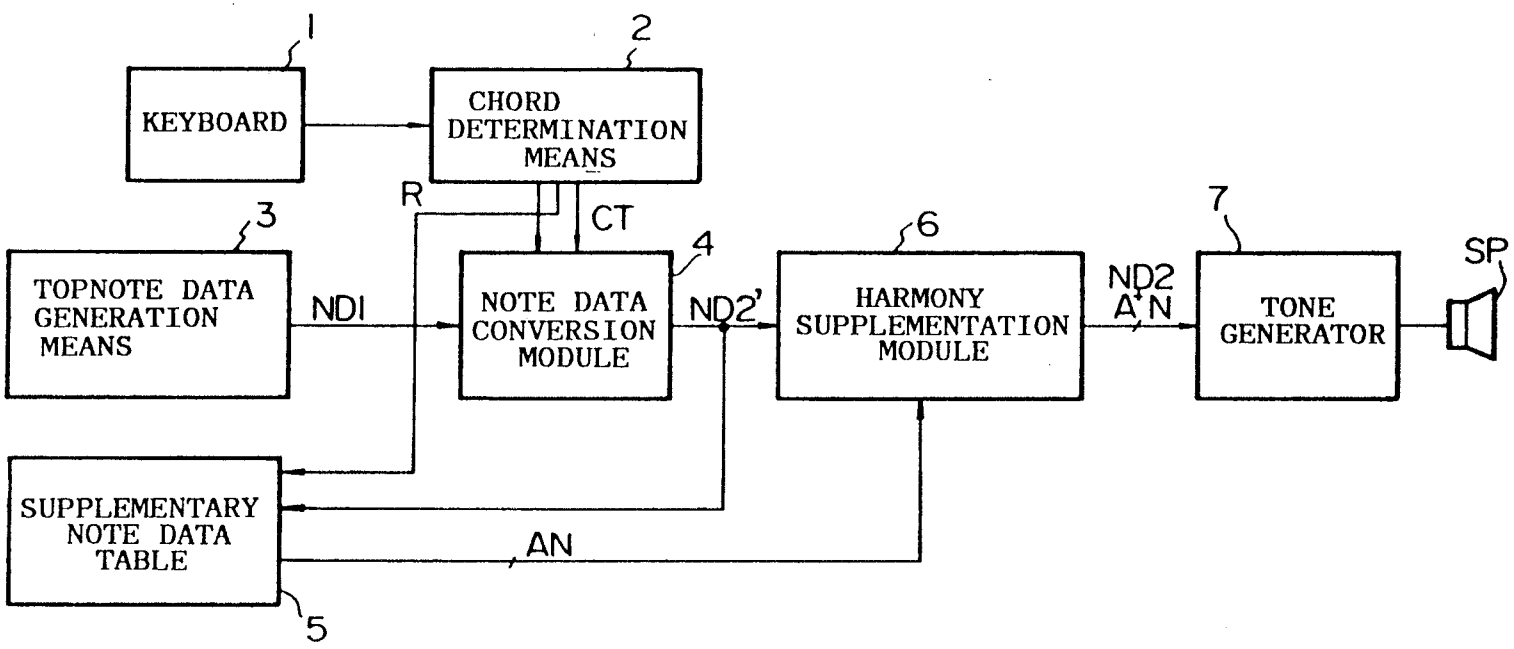
FIG. 1 is a block diagram illustrating the function of the electronic musical instrument in accordance with present invention.

First of all, the overall function of the present invention will be described with reference to FIG. 1. FIG. 1 is a block diagram which schematically illustrates the basic function of the electronic musical instrument of the present invention. In this drawing, a keyboard 1 can be seen, which comprises of a plurality of white and black keys, arranged similarly to those of a conventional piano keyboard. Any contiguous section of keyboard 1 can be designated as an automatic accompaniment region, whereby the keys therein come to be allocated as input operators for automatic accompaniment information.

The state of keys within a designated automatic accompaniment region is determined by a chord determination means 2. That is to say, chord determination means 2 determines which, if any, of the keys within the automatic accompaniment region are depressed. Based on the determined state of the automatic accompaniment region, information indicating the root note data R and chord type data CT for a chord in an accompaniment is determined and supplied to a note data conversion module 4. The chord type data CT is also supplied to a supplementary note data table 5. Here, chord type data CT designates whether a chord is, for example, a major chord, minor chord, diminished seventh chord, etc.

Also shown in FIG. 1 is a top note data generation means 3 which reads top note data from memory representing the uppermost key of a chord, the result of which is supplied to note data conversion module 4 as note data ND1. In note data conversion module 4, based on the supplied chord type data CT, note data ND1 is converted to note data ND2 which is then supplied to supplementary note data table 5 and a harmony supplementation module 6. In supplementary note data table 5, based on the supplied chord type data CT and note data ND2, supplementary note data AN representing a supplementary note to be generated is read out and supplied to harmony supplementation module 6.

In harmony supplementation module 6, supplementary note data AN from supplementary note data table 5 is combined with note data ND2 obtained by converting note data ND1 from top note data generation means 3 in note data conversion module 4. The result of combining supplementary note data AN and note data ND2 is a prescribed musical interval (supplementary note data AN+note data ND2) which is supplied to a tone generator 7. In tone generator 7, the musical interval defined by the sum of supplementary note data AN and note data ND2 is converted to an analog signal which is then supplied to a speaker SP, resulting in the production of musical sound.

Figure 2:
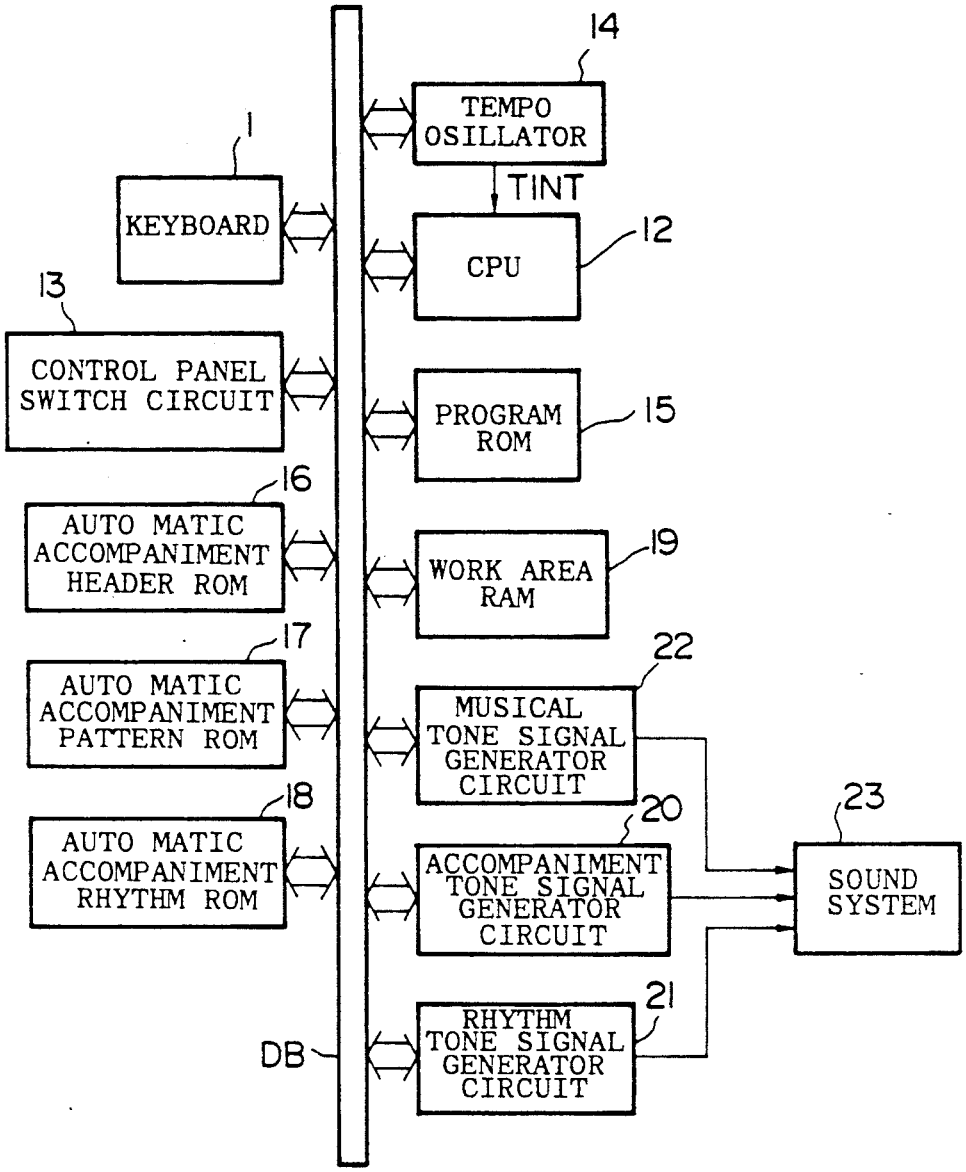
FIG. 2 is a block diagram illustrating the layout of an electronic musical instrument in accordance with an aspect of the present invention.

The basic function of the present invention having been thus described, a more specific description will now be presented with reference to FIG. 2, which is a block diagram illustrating the layout of an electronic musical instrument in accordance with a first preferred embodiment of the present invention. Elements in FIG. 2 which are identical to elements previously described with reference to FIG. 1 will retain the original identifying numeral.

In FIG. 2, control panel switch circuitry 13 can be seen which includes multiple control panel switch operators whereby various musical control factors can be designated, such as timbre, accompaniment style, musical data storage address (song selection), and others. Data indicating the state of each of the control panel switch operators is supplied to a CPU 12 via a data bus DB.

Also shown in FIG. 2 is a tempo oscillator 14 which generates a clock signal having a predetermined frequency. This clock signal is supplied to CPU 12 as a tempo interrupt clock signal TINT which will be described further on.

Among its functions, CPU 12 controls the overall operation of the electronic musical instrument of the present invention based on a control program stored in program ROM 15. Based on the state of the above described control panel switch operators associated with control panel switch circuitry 13, various operating parameters are supplied to CPU 12 via data bus DB from automatic accompaniment header ROM 16, automatic accompaniment pattern ROM 17 and automatic accompaniment rhythm pattern ROM 18. Results of processing carried out in CPU 12 can be temporarily stored in work area RAM 19. In addition to the control program stored therein, program ROM 15 also stores a note data conversion table which is shown in FIG. 10 and a harmony table which is shown in FIG. 11, both of which will be described in a later section.

For each accompaniment style which can be designated by the electronic musical instrument of the present invention, automatic accompaniment pattern ROM 17 holds accompaniment note pattern data in data tables corresponding to various different types of accompaniment patterns played by any of various different instruments which can be designated. In automatic accompaniment header ROM 16, address data are stored which indicate the location of the above described data tables in automatic accompaniment pattern ROM 17, such as read data pointers RDPTR will be described later. Automatic accompaniment rhythm pattern ROM 18 holds data indicating rhythm pattern timing for various musical instruments (timbres) in multiple different rhythm styles which can be freely designated.

Among the different timbre parameters stored in ROM in the electronic musical instrument of the present invention, parameters indicating timbre for the accompaniment pattern are supplied to an accompaniment tone signal generator 20, parameters indicating timbre for the rhythm pattern are supplied to a rhythm tone signal generator 21, and parameters indicating timbre for other tones to be generated are supplied to a musical tone signal generator 22. The accompaniment tone signal from accompaniment tone signal generator 20, rhythm tone signal from rhythm tone signal generator 21, and a melody tone signal from musical tone signal generator 22 are each supplied to a sound system 23 wherein these digital signals are converted to a composite analog signal which is amplified and supplied to speaker SP, thereby resulting in the production of musical sound.

Next the flow of operation in the electronic musical instrument of the present invention will be described with reference to the flow charts of FIGS. 3 through 7.

Figure 3:
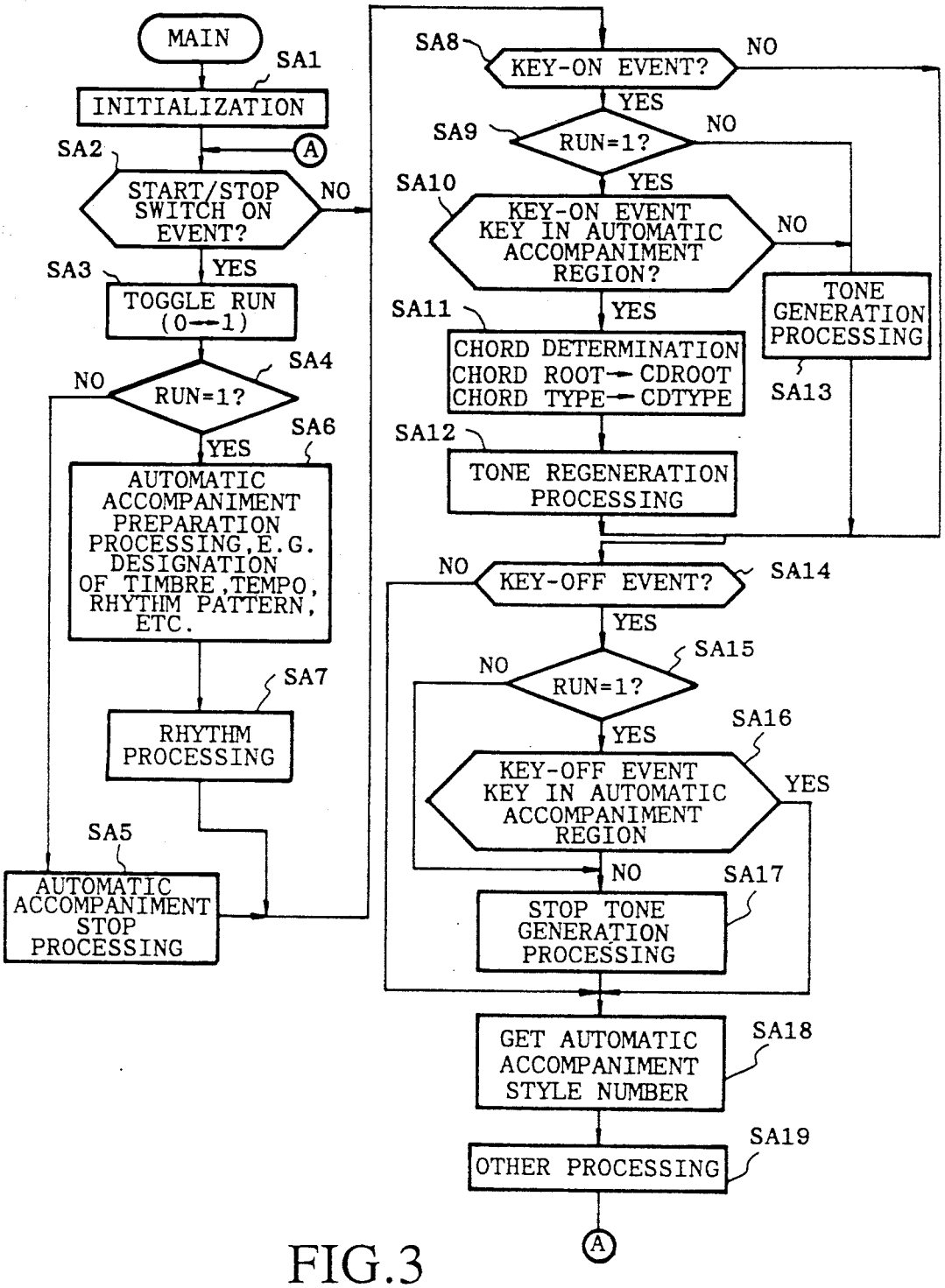
FIG. 3 is a flow chart illustrating main routine operative in the electronic musical instrument shown in the block diagram of FIG. 2 above.

Starting at MAIN in FIG. 3, after the power supply is activated, initialization of data registers and the like is carried out in step SA1. Next, whether an automatic accompaniment start/stop switch is depressed or not is determined in a step SA2. When the result of the judgement in SA2 is [YES], the routine proceeds to step SA3, wherein a one-bit register RUN which indicates the operating state of automatic accompaniment is toggled. When register RUN is set to [1], this indicates that automatic accompaniment is active, whereas when register RUN is cleared to [0], this indicates that automatic accompaniment is stopped. Next, in step SA4, judgement is made as to whether register RUN is set to [1] or not, that is, whether automatic accompaniment is active or not. When the result of the judgement in SA4 is [NO], the routine then proceeds to step SA5 wherein automatic accompaniment stop processing is carried out.

Conversely, when the result of the judgement in SA4 is [YES], in other words, when register RUN is set to [1], the routine proceeds to step SA6 wherein preparation processing for automatic accompaniment is carried out. In the preparation processing of step SA6, according to the style number stored in an automatic accompaniment style register AASTYLN, corresponding automatic accompaniment timbre parameters, read data pointer RDPTR, harmony table number, etc. are read out from automatic accompaniment pattern ROM 17. Additionally, in the preparation processing, tempo data indicating a tempo interrupt processing interval which will be described below is read out from automatic accompaniment rhythm pattern ROM 18. The routine then proceeds to step SA7 wherein rhythm tone generation processing is carried out. Herein, rhythm tone signal generator 21 generates a rhythm tone signal based on corresponding parameters supplied thereto, after which the rhythm tone signal is supplied to sound system 23 and converted to an audible rhythm pattern.

As mentioned above, when the result of the judgement in SA4 is [NO], the routine proceeds to step SA5 wherein automatic accompaniment stop processing is carried out. When the processing in step SA5 is completed, or alternatively, when the rhythm processing of step SA7 is completed, the routine then proceeds to a step SA8 wherein judgement is made as to whether a key-on event has occurred or not. When the result of the judgement in SA8 is [YES], the routine then proceeds to step SA9 wherein judgement is made as to whether register RUN is set to [1] or not. When automatic accompaniment is active, the result of the judgement is step SA9 is [YES], whereupon the routine proceeds to step SA10.

Figure 13:
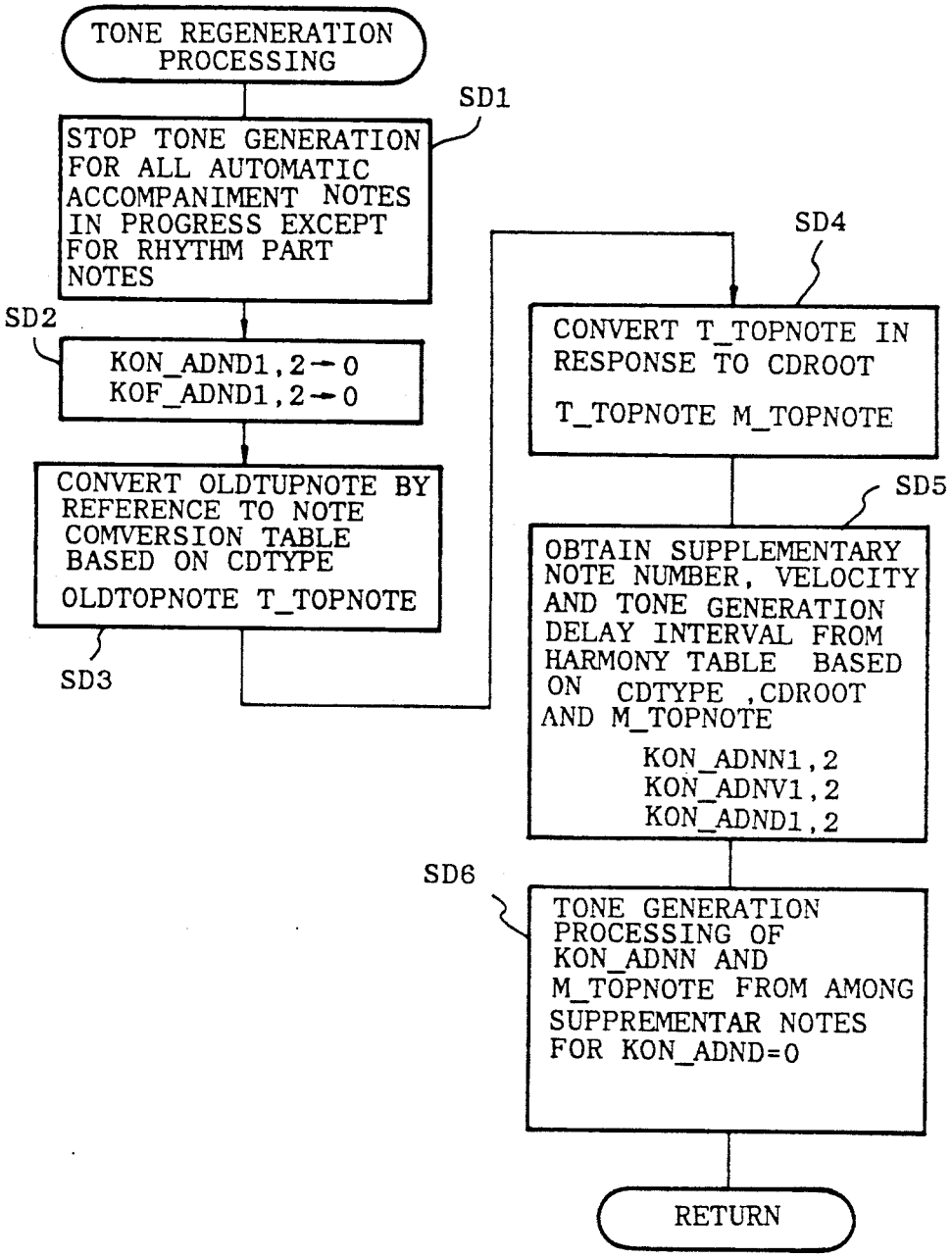
FIG. 13 is a flow chart illustrating tone regeneration processing operative in the electronic musical instrument shown in FIG. 2.

In step SA10, judgement is made as to whether the key-on event which took place corresponds to a key within the automatic accompaniment region on the keyboard. When the result of this judgement is [YES], that is, when a key in the automatic accompaniment region has been depressed, this is considered to be a chord change and the routine proceeds to step SA11. In step SA11, data representing the chord root is stored in register CDROOT and data representing the chord type is stored in register CDTYPE. The routine then proceeds to step SA12 wherein the tone regeneration processing shown in FIG. 13 is carried out. In the processing of step SA12, which will be described further on, tone generation is temporarily stopped and a new chord is generated.

When the result of the determination in step SA9 is [NO], or when the determination of step SA10 indicates that the key-on event which took place corresponds to a key outside of the automatic accompaniment region, the routine proceeds to step SA13 wherein tone generation processing is carried out. In the tone generation processing of step SA13, in the response to the particular key depressed, parameters corresponding to a musical interval are supplied to musical tone signal generator 22. Musical tone signal generator 22 then generates the corresponding musical tone signal which is supplied to sound system 23 and converted to an analog signal therein which is finally produced by speaker SP as an ordinary note of a song.

When the chord change processing of step SA12 mentioned above has completed, or when the tone generation processing of step SA13 has completed, the routine proceeds to step SA14 wherein judgement is made as to whether a key-off event has taken place or not. When the result of this judgement is [YES], the routine proceeds to step SA15 wherein judgement is made as to whether register RUN is set to [1] or not. When the result of this judgement is [YES], the routine then proceeds to step SA16 wherein judgement is made as to whether the key-off event which has taken place corresponds to the automatic accompaniment region of the keyboard or not. When the key-off event does not correspond to the automatic accompaniment region, and the result of the judgement in step SA16 therefore [NO], the routine then proceeds to step SA17 wherein processing for the termination of tone generation for ordinary notes not part of an accompaniment part is carried out. The routine similarly proceeds to step SA17 when the judgement of step SA14 indicates that a key-off event has taken place and the judgement of step SA15 indicates that register RUN holds a value of [0].

When a key-off event has not taken place, or when a key-off event has occurred, but is outside of the automatic accompaniment region, or when the processing of step SA17 has completed, the routine then proceeds to step SA18. In step SA18, the automatic accompaniment style number designated by control panel switch circuitry 13 is stored in register AASTYLN. The routine then proceeds to step SA19, and when the other processing in step SA19 is completed, returns back to step SA2. The above described cycle of steps from step SA2 to step SA19 then repeats.

Figure 4:
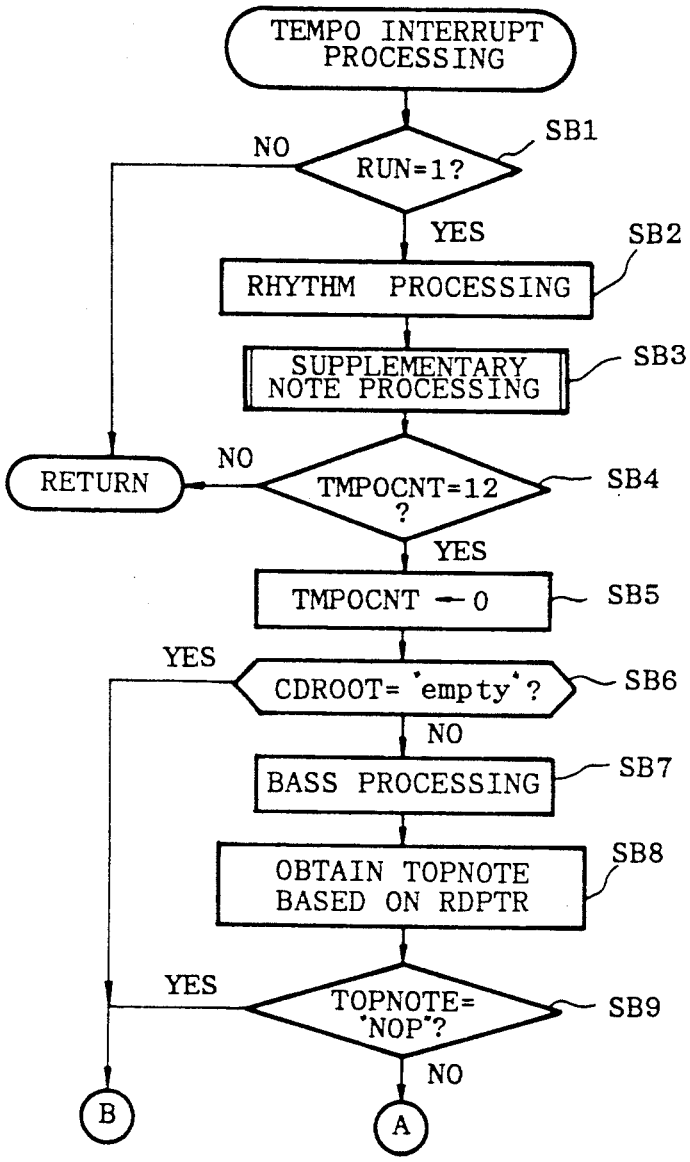
FIG. 4 is a flow chart illustrating tempo interrupt processing operative in the electronic musical instrument shown in FIG. 2 above.
Figure 5:
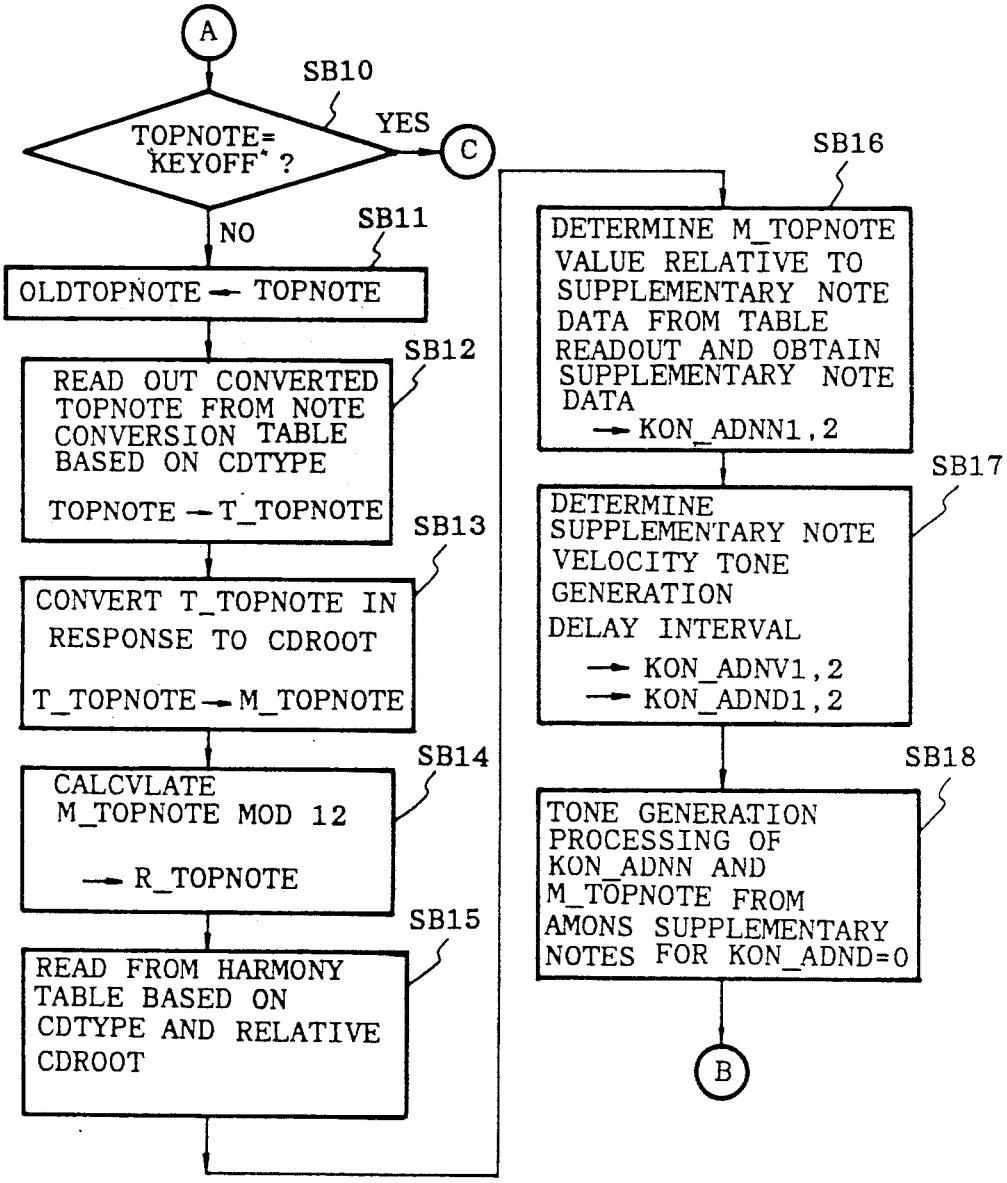
FIG. 5 is another flow chart illustrating tempo interrupt processing operative in the electronic musical instrument shown in FIG. 2 above.
Figure 6:
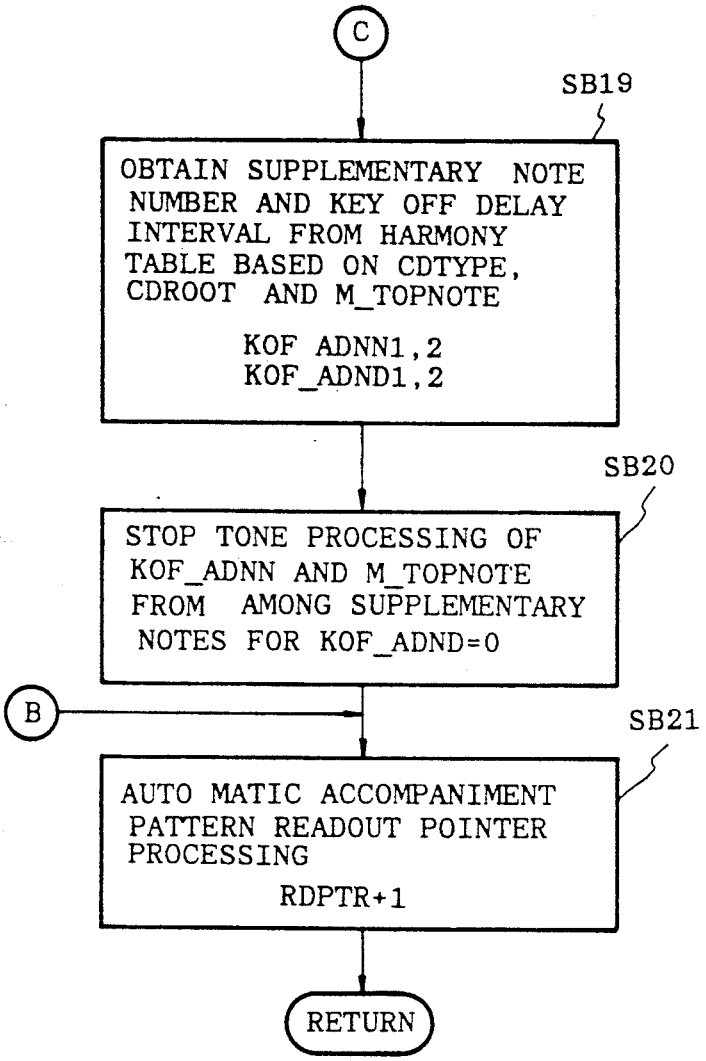
FIG. 6 is yet another flow chart illustrating tempo interrupt processing operative in the electronic musical instrument shown in FIG. 2 above.
Figure 7:
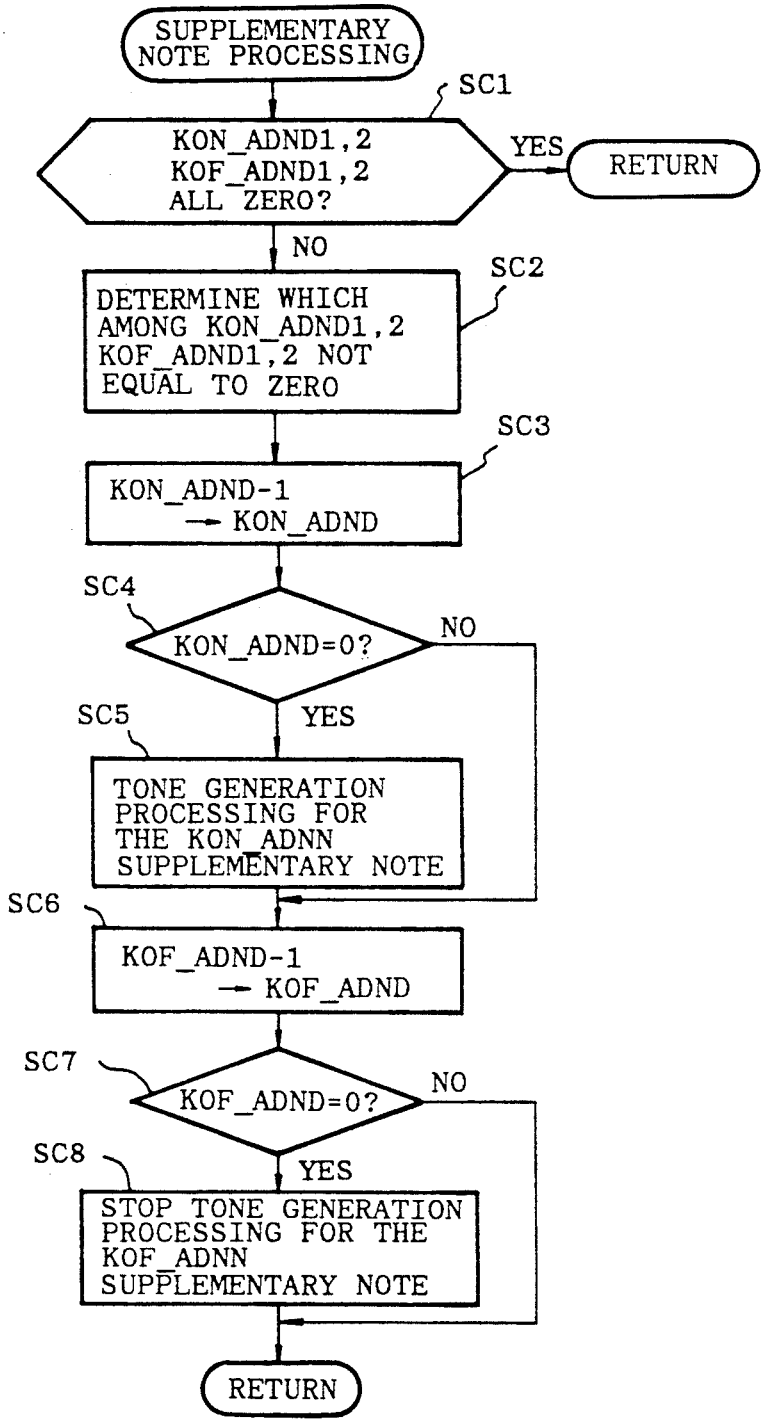
FIG. 7 is a flow chart illustrating supplemental note processing operative in the electronic musical instrument shown in FIG. 2 above.

In addition to the above described steps which are shown in the flow chart of FIG. 3, CPU 12 also carries out the tempo interrupt processing shown in FIGS. 4 through 6 based on a tempo interrupt clock signal TINT from tempo oscillator 14, and carries out the supplementary note processing shown in FIG. 7. From tempo interrupt processing shown in the flow chart of FIG. 4, the routine proceeds to step SB1, wherein judgement is made as to whether register RUN is set to [1] or not. When the result of the judgement in SB1 is [NO], that is, when it is determined that automatic accompaniment is not active, the routine returns or ordinary processing.

When the result of the judgement in SB1 is [YES], the routine proceeds to step SB2 wherein rhythm tone generation processing is carried out. The routine then proceeds to step SB3 wherein the supplementary note processing shown in the flow chart of FIG. 7 is carried out.

In the supplementary note processing, first of all, in a step SC1, judgement is made as whether all of register KON_ADND1, register KON_ADND2, register KOF_ADND1 and register KOF_ADND2 hold a value of [0]. Register KON_ADND1 and register KON_ADND2 are used to hold delay intervals for supplementary notes other that the root note for chords corresponding to key-on events. Register KOF_ADND1 and register KOF_ADND2 are used to hold delay intervals for supplementary notes other that the root note for chords corresponding to key-off events. Thus, when any of these registers hold a value other than [0], generation or termination of generation of corresponding supplementary notes occurs only after a predetermined delay interval. When the result of the judgement in step SC1 is [YES], that is, when each of the four registers hold a value of [0], since the tone generation processing or stop tone generation processing for supplementary notes must be carried out simultaneously with processing for corresponding root notes, the routine returns immediately to the tempo interrupt processing routine shown in FIG. 4.

When the result of the judgement in SC1 is [NO], that is, when one or more of register KON_ADND1, register KON_ADND2, register KOF_ADND1 and register KOF_ADND2 hold a non-zero value, the routine shown in FIG. 7 proceeds to step SC2. In step SC2, a determination is made as to which of the four registers has a non-zero value, whereupon the routine proceeds to step SC3. In step SC3, either of register KON_ADND1 or register KON_ADND2 which has a non-zero value is decremented by one, whereupon the routine proceeds to step SC4 wherein a determination is made as to whether the decremented register has acquired a value of [0]. When the result of the determination is [YES], that is, when the delay interval for the supplementary note is zero, the routine then proceeds to step SC5. In step SC5, the supplementary note is generated for the register which acquired a value of [0] in step SC3, whereupon the routine proceeds to step SC6. Conversely, when the result of the determination in step SC4 is [NO], the routine goes directly to step SC6.

In step SC6, either of register KOF_ADND1 or register KOF_ADND2 which has a non-zero value is decremented by one, whereupon the routine proceeds to step SC7 wherein a determination is made as to whether the decremented register has acquired a value of [0]. When the result of the determination is [YES], that is, when the delay interval for the supplementary note is zero, the routine then proceeds to step SC8. In step SC8, generation of the supplementary note is stopped for the register which acquired a value of [0] in step SC6, whereupon the routine returns to the tempo interrupt processing shown in FIGS. 4 through 6. When the result of the determination in step SC7 is [NO], the routine returns directly to tempo interrupt processing.

After completion of step SC1 or step SC8 and the routine has returned to tempo interrupt processing, starting with step SB4 wherein a judgement is made as to whether the value held in tempo counter TMPOCNT is [12] or not. When the result of this judgement is [YES], tempo interrupt processing stops and the routine returns to the routine which was being executed immediately prior to entering the tempo interrupt processing routine. Accordingly, it can be seen that a complete cycle for tempo counter TMPOCNT consists of twelve clock pulses. This timing is related to rhythm processing to allow precise execution thereof, and is different for timing related to automatic accompaniment processing.

When the result of the Judgement in SB4 is [NO], the routine proceeds to step SB5 wherein tempo counter TMPOCNT is reset to [0], whereafter the routine proceeds to step SB6 wherein Judgement is made as to whether register CDROOT is empty or not. The purpose of this step is to determine whether rhythm tone generation is in progress, or whether a chord is not being played. When register CDROOT is not empty, the result of the Judgement in step SB6 is [NO] and the routine proceeds to step SB7. In step SB7, bass processing is carried out based on the content of register CDROOT. Next, in step SB8, based on the pattern data read pointer RDPTR, top note TOPNOTE is obtained. This pattern data read pointer RDPTR indicates the memory address from which the accompaniment pattern is read out.

As an example, when the accompaniment pattern shown in FIG. 8 is to be played, the top note progression is "do" (C), "re" (D), "mi" (E), "ti" (B), "ra" (A) and (G#). In FIG. 9, this top note progression is shown in terms of the corresponding MIDI numbers, 72, 73, 74, 71 and 70. FF in FIG. 9 indicates NOP (no operation), a step in which no action is taken, whereas 00 indicates a key-off operation. Returning to the description of step SBS, the obtained value for top note TOPNOTE is [72].

The routine then proceeds to step SB9 wherein a determination is made as to whether top note TOPNOTE equals FF (NOP). When top note TOPNOTE equals FF in step SB9, or when register CDROOT is empty in step SB6, and the result of the corresponding judgement is thus [YES], the routine proceeds to step SB21 shown in FIG. 6. In step SB6, pattern data read pointer RDPTR is incremented, the tempo interrupt processing terminates, and the routine returns to the processing in effect prior to interrupt processing.

When the result of the judgement in step SB9 [NO], the routine proceeds to step SB10 which FIG. 5. In step SB10, determination is made as to whether top note TOPNOTE equals 00 (key-off). Since the result of the Judgement in step SP10 is [NO] in this case, the routine proceeds to step SB11 wherein the value for top note TOPNOTE is stored in register OLDTOPNOTE. The routine then proceeds to step SB 12.

If it is assumed that the operator has played a Gm (G minor) chord, then the note conversion in following step SB12 is carried out by reference to the note data conversion table based on a CDTYPE of minor. In step SB12, the value of topnote TOPNOTE is converted, and the result obtained thereby is stored in register T_TOPNOTE. Although topnote TOPNOTE is converted by reference to the note data conversion table using TOPNOTE and CDTYPE, first the note name for topnote TOPNOTE is obtained.

In this example, the obtained value of [72] for topnote TOPNOTE does not correspond to a note name. By using the rules relating to MIDI root note numbers, the note name "do" is known to correspond to MIDI note numbers which are integral multiples of twelve. As can be appreciated from FIG. 10, by carrying out modulo division by twelve on the root note number, the note name can be obtained.

Returning to the description of the processing shown in the flow chart of FIG. 5, after the value of [72] obtained in this example by the note data conversion carried out in step SB12 is stored in register T_TOPNOTE, the routine proceeds to step SB13 wherein the content of register T_TOPNOTE is converted based on chord root CDROOT, the result of which is stored in register M_TOPNOTE. To convert the value held in T_TOPNOTE, it is first necessary to transpose TOPNOTE based on chord root CDROOT. Since chord root CDROOT is G in this example, and the accompaniment data is stored in the key of C, G must be transposed to the key of C, an interval of seven half-steps as can be seen in FIG. 10. Consequently, the value stored in register M_TOPNOTE is $72+7=79$.

Moving on to step SB14, the value stored in register M_TOPNOTE is subjected to modulo division by 12, thus yielding 7 in this example which is stored in register R_TOPNOTE. Next in step SB15, the harmony table is referenced based on chord type CDTYPE and on the relative difference of the value in register R_TOPNOTE and chord root CDROOT. In this example, since chord root CDROOT is G, a value of 7 is obtained from the table in FIG. 10. Accordingly, the relative difference of the value in register R_TOPNOTE and chord root CDROOT is 0.

Next, in step SB16, supplementary notes are obtained from the harmony table, and then stored in registers KON_ADNN1 and KON_ADNN2. Since the chord type is m, on reference to the harmony table shown in FIG. 12, the box with oblique solid lines containing the values $-5$ and $-8$ is selected. Because these represent values relative to the top note, the actual supplementary notes are obtained by summing these values with the content of M_TOPNOTE. Accordingly, in the present example, $M_TOPNOTE+(-5)=79-5=74$ is stored in register KON_ADNN1. Similarly, $M_TOPNOTE+(-8)=79-8=71$ is stored in register KON_ADNN2. These values are subsequently supplied to the tone generator as MIDI numbers.

Next, in step SB17, supplementary note velocities ED and EC are obtained and stored in registers KON_ADNV1 and KON_ADNV2. These values are relative to the top note velocity. Next, delay intervals 00 and 00 are obtained and stored in registers KON_ADND1, 2. Next, in step SB18, tone are generated from among the supplementary notes stored in registers KON_ADNN1, 2 and M_TOPNOTE for KON_ADND1 or KON_ADND2=0. Proceeding to step SB21, pattern data read pointer RDPT is incremented, whereupon this tempo interrupt processing is completed and processing returns to the prior routine.

When the result of the determination in step SB10 is [YES], the routine proceeds to step SB19 shown in FIG. 6, wherein the harmony table is referenced based on chord type CDTYPE, chord root CDROOT and the value in register M_TOPNOTE to obtain supplementary note numbers which are stored in registers KOF_ADNN1, 2 and delay times for termination of tone Generation which are stored in registers KOF_ADND1, or KON_ADND2. Then, in step SB20, stop tone Generation processing is carried out from among the supplementary notes stored in registers KOF_ADNN1, 2 and for M_TOPNOTE for KOF_ADND1 or KON_ADND2=0. Proceeding to step SB21, pattern data read pointer RDPT is incremented, whereupon this tempo interrupt processing is completed and processing returns to the prior routine.

Concerning the above mentioned tone regeneration processing, this will be explained with reference to the flow chart of FIG. 13. First, in step SD1, automatic accompaniment notes being Generated are excluded from the rhythm part, and tone Generation is stopped. Then in step SD2, registers KOF_ADNN1, 2 and KOF_ADND1, 2 are set to zero. If tone Generation is not temporarily stopped in this way, when clearing of the delay interval values is carried out, tone Generation will be interrupted. Then, in step SD3, chord type CDTYPE is made standard, and the value stored in register OLDTOPNOTE is converted via reference to the note data conversion table, after which the converted value is stored in register T_TOPNOTE.

Next, in step SD4, the content of register T_TOPNOTE is converted based on chord root CDROOT, the result of which is stored in register M_TOPNOTE. Then, in step SD5, supplementary note numbers, velocity data and tone generation delay intervals are determined by reference to a harmony table based on chord type CDTYPE, chord root CDROOT and the value in register M_TOPNOTE. The obtained supplementary note numbers are then stored in registers KON_ADNN1 and KON_ADNN2, the velocities in registers KON_ADNV1 and KON_ADNV2 and the delay intervals in registers KON_ADND1 and KON_ADND2. Then, in step SD6, tone generation processing is carried out for registers KON_ADND1 and KON_ADND2 which have attained a value of [0], and for M_TOPNOTE.

Now, the processing which takes place when the number 76 is read out from the chart shown in FIG. 8 will be described. It will be assumed that the operator played an Fm chord.

In step SB12 of the tempo interrupt processing routine, note conversion is carried out by reference to the note data conversion table based on a CDTYPE of minor. Modulo division of 76 by 12 gives 4, for which reason the note name for topnote TOPNOTE is E. Since the chord type is m, on reference to the harmony table shown in FIG. 12, the box with oblique broken lines containing the values −3 and −8 is selected. In this example, the value stored in register T_TOPNOTE is thus 76−1=75.

Next, in step SB13, the content of register T_TOPNOTE is converted based on chord root CDROOT, the result of which is stored in register M_TOPNOTE. Since chord root CDROOT is F in this example, and the accompaniment data is stored in the key of C, G must be transposed to C, an interval of five half-steps as can be seen in FIG. 10. Consequently, the value stored in register M_TOPNOTE is 75+5=80.

In following step SB14, the value stored in register M_TOPNOTE is subjected to modulo division by 12, thus yielding 8 in this example which is stored in register R_TOPNOTE. Next in step SB15, the harmony table is referenced based on chord type CDTYPE and on the relative difference of the value in register R_TOPNOTE and chord root CDROOT. In this example, since the chord topnote is G#, a value of 7 is obtained from the table in FIG. 10. Since the chord type is m, on reference to the harmony table shown in FIG. 12, the box with oblique broken lines containing the values −3 and −8 is selected.

In step SB16, 3 is subtracted from M_TOPNOTE yielding 77 which is stored in register KON_ADNN1. Similarly, 8 is subtracted from M_TOPNOTE yielding 72 which is stored in register KON_ADNN2. Following processing is similar to that previously described for the same steps.

Although the present embodiment has been described using the top note as the note to be converted, the invention is not so limited. As an example, the bottom note can be used in analogous calculations.

Additionally, multiple harmony tables can be employed in the electronic musical instrument of the present invention rather than only one as has been described herein. Furthermore, four, five or even more supplementary notes can be generated for chords rather that only two as described above. Supplementary notes can also be generated from harmony tables based on a correspondence with notes in the melody part.

If multiple harmony tables are to be utilized, it is possible to allocate a different one for each available accompaniment style, whereby the performer can freely select an accompaniment style with a corresponding unique harmony table. By so doing, a great number of variations become possible for each accompaniment pattern. It is also possible to designate multiple harmony tables so that each corresponds to one or more unique top note values. By making the delay times for supplementary notes from the harmony tables adjustable by the performers, it becomes possible to automatically generate arpeggios.

Although top notes have all shared common velocity data in the embodiment of the present invention described herein, it is possible to independently allocate velocity data for each note. In addition to delay times and velocity data, it is possible to include other tone generation control parameters in the data tables, for example, timbre, amplitude envelope, etc.

Although the invention has been described as generating a single accompaniment part, it is not so limited and two or more accompaniment parts can be generated simultaneously during a performance.

Note data stored in memory has been described as absolute data in the form of MIDI note numbers. The invention is not so limited, however, and note data can be stored in a format defined as relative to some chosen standard. With such a design, subsequent tone generation and related processing is carried out with all notes determined relative to the preselected standard.

What is claimed is:

1. An electronic musical instrument comprising:

a) chord determination means for determining a chord type of a chord;

b) accompaniment pattern generation means for generating an accompaniment pattern comprising accompaniment pattern note data representing a sequence of notes, by sequentially generating said accompaniment pattern note data;

c) supplementary note generation means for generating supplementary note data designating at least one supplementary note based on said determined chord type and said accompaniment pattern note data, such that any supplementary note designated by said supplementary note data is a note other than respective sequential notes designated by said accompaniment pattern note data from said accompaniment pattern generation means; and d) a tone generator for generating accompaniment tones based on said accompaniment pattern note data and said supplementary note data.

2. An electronic musical instrument comprising:

a) chord determination means for determining a chord type of a chord;

b) accompaniment pattern generation means for generating an accompaniment pattern comprising accompaniment pattern note data representing a sequence of notes, by sequentially generating said accompaniment pattern note data;

c) supplementary note generation means for generating supplementary note data designating at least one supplementary note based on said determined chord type and said accompaniment pattern note data, and for additionally generating tone generation delay interval data corresponding to the supplementary note data, wherein any supplementary note designated by said supplementary note data is a note other than respective sequential notes designated by said accompaniment pattern note data from said accompaniment pattern generation means; and d) a tone generator for generating accompaniment tones based on said accompaniment pattern note data and said supplementary note data, such that a tone designated by said supplementary note data is generated later than a corresponding tone designated by said accompaniment pattern note data by a time corresponding to said tone generation delay interval data.

3. An electronic musical instrument comprising:

a) chord determination means for determining a chord type of a chord;

b) accompaniment pattern generation means for generating an accompaniment pattern comprising accompaniment pattern note data representing a sequence of notes, by sequentially generating said accompaniment pattern note data;

c) supplementary note generation means for generating supplementary note data designating at least one supplementary note for said chord based on said determined chord type and said accompaniment pattern note data, and for additionally generating volume data corresponding to the supplementary note data, wherein any supplementary note designated by said supplementary note data is a note other than respective sequential notes designated by said accompaniment pattern note data from said accompaniment pattern generation means; and d) a tone generator for generating accompaniment tones based on said accompaniment pattern note data and said supplementary note data, such that a tone designated by said supplementary note data is generated in a tone volume corresponding to said volume data.

4. An electronic musical instrument in accordance with claim 1, 2 or 3, wherein said accompaniment pattern note data is higher than said supplementary note data in pitch.

5. An electronic musical instrument in accordance with claim 1, 2 or 3, wherein said accompaniment pattern note data is a root of said chord.

6. An electronic musical instrument in accordance with any of claim 1, 2 or 3 further comprising an operable member connected to said chord determination means for designating said chord.

7. An electronic musical instrument in accordance with claim 1, 2 or 3, wherein said accompaniment pattern note data is lower than said supplementary note data in pitch.

8. An electronic musical instrument in accordance with claim 1, 2 or 3, wherein said accompaniment pattern generation means comprises an accompaniment pattern memory for storing said accompaniment pattern.

9. An electronic musical instrument in accordance with claim 1 to 4, 6 and 7 to 8, wherein said accompaniment pattern generation means further comprises note data conversion means for generating converted accompaniment pattern note data from said accompaniment pattern note data based on said chord type, such that aid converted accompaniment pattern note data is used by said supplementary note generation means for generating said supplementary note data.

10. An electronic musical instrument in accordance with claim 9, wherein said chord determination means further determines a root note of said chord, and wherein said supplementary note generating means designates said supplementary note data further based on said determined root note.

* * * * *